US009976435B2

(12) United States Patent
Borja et al.

(10) Patent No.: US 9,976,435 B2
(45) Date of Patent: May 22, 2018

(54) BLADE TIP CLEARANCE SYSTEMS

(71) Applicant: United Technologies Corporation, Farmington, CT (US)

(72) Inventors: Mark Borja, Palm Beach Gardens, FL (US); Paul W. Palmer, S. Glastonbury, CT (US)

(73) Assignee: UNITED TECHNOLOGIES CORPORATION, Farmington, CT (US)

( * ) Notice: Subject to any disclaimer, the term of this patent is extended or adjusted under 35 U.S.C. 154(b) by 216 days.

(21) Appl. No.: 14/884,015

(22) Filed: Oct. 15, 2015

(65) Prior Publication Data

US 2016/0177768 A1 Jun. 23, 2016

Related U.S. Application Data

(60) Provisional application No. 62/094,691, filed on Dec. 19, 2014.

(51) Int. Cl.

| | |
|---|---|
| ***F01D 11/18*** | (2006.01) |
| ***F01D 5/02*** | (2006.01) |
| ***F01D 25/24*** | (2006.01) |

(52) U.S. Cl.

CPC ..... *F01D 11/18* (2013.01); *F01D 5/02* (2013.01); *F01D 25/24* (2013.01); (Continued)

(58) Field of Classification Search

CPC . F01D 11/18; F01D 5/02; F01D 25/24; F01D 5/10; F01D 5/16; F01D 5/26; (Continued)

(56) References Cited

U.S. PATENT DOCUMENTS

| | | | | |
|---|---|---|---|---|
| 5,593,278 | A | 1/1997 | Jourdain et al. | |
| 8,292,573 | B2 * | 10/2012 | Broomer | F01D 9/041 415/178 |
| 2012/0275898 | A1 * | 11/2012 | McCaffrey | F01D 11/18 415/1 |

FOREIGN PATENT DOCUMENTS

| | | | |
|---|---|---|---|
| DE | 10251468 | A1 | 5/2004 |
| EP | 2728124 | A1 | 5/2014 |
| WO | 2014133644 | A2 | 9/2014 |

OTHER PUBLICATIONS

English Abstract for DE10251468A1—May 19, 2004; 2 pgs.

(Continued)

*Primary Examiner* — Igor Kershteyn
*Assistant Examiner* — Eric Zamora Alvarez
(74) *Attorney, Agent, or Firm* — Cantor Colburn LLP

(57) ABSTRACT

A rotating blade tip clearance system includes a control ring carrier defining a centerline axis. The control ring carrier has a connecting portion, a retaining portion radially inward of the connecting portion, and a flange connecting radially between the connecting portion and the retaining portion. The flange isolates the retaining portion of the control ring carrier from the thermal deflection of a case and assists in keeping the control ring carrier aligned about centerline axis A during thermal deflection. The retaining portion includes radially inner and outer diameter sides defining a retaining cavity therebetween. The system includes a control ring within the retaining cavity. The control ring has a different thermal response rate from the control ring carrier so that the control ring thermally deflects slower than the control ring carrier, thereby controlling the rate and/or extent of thermal deflection of the control ring carrier.

16 Claims, 7 Drawing Sheets

(52) U.S. Cl.
CPC ..... *F05D 2220/32* (2013.01); *F05D 2230/21* (2013.01); *F05D 2230/22* (2013.01); *F05D 2230/30* (2013.01); *F05D 2240/24* (2013.01); *F05D 2240/307* (2013.01)

(58) Field of Classification Search
CPC . F01D 9/02; F01D 9/041; F01D 25/06; F05D 2220/32; F05D 2230/21; F05D 2230/22; F05D 2230/30; F05D 2240/24; F05D 2230/307; F05D 2250/313; F05D 2250/12; F05D 2250/131; F05D 2250/121; F05D 2250/141; F05D 2220/3212; F05D 2220/3215; F05D 2220/3219; F05D 2220/3217; F05D 2260/96; F05D 2240/129; F05D 2240/30; F04D 29/668; F04D 29/324; F04D 29/662; Y02T 50/671
See application file for complete search history.

(56) References Cited

OTHER PUBLICATIONS

English Abstract for EP2728124A1—May 7, 2014; 1 pg.
European Search Report for Application No. 15190469.5-1610; dated May 18, 2016; 9 pgs.

* cited by examiner

BLADE TIP CLEARANCE SYSTEMS

CROSS REFERENCE TO RELATED APPLICATIONS

This application claims the benefit of U.S. Provisional Patent Application Ser. No. 62/094,691 filed Dec. 19, 2014, the entire contents of which are incorporated herein by reference thereto.

STATEMENT REGARDING FEDERALLY SPONSORED RESEARCH OR DEVELOPMENT

This invention was made with government support under contract number N68335-13-C-0005 awarded by the United States Navy. The government has certain rights in the invention.

BACKGROUND

The present disclosure relates to seals, and more particularly to seals for turbomachinery, such as for example seals between a case and rotor turbine blades in a gas turbine engine.

Leakage of flow-path air may occur in turbomachinery between the tips of a rotating blade structure and the outer static structure. This leakage has a negative effect on performance, efficiency, fuel burn, and component life. Turbomachinery with a wide operating range, such as an aircraft gas turbine engine, conventionally requires large tip clearances due to the mismatch in thermal responses between the rotating structure and the static structure. A static structure with a rapid thermal response rate will experience significant closure to the rotating structure during rapid decelerations. Conversely, a static structure with a slow thermal response will experience significant closure to the rotating structure during rapid accelerations. Further, the rotating blade structure generally includes two rotating structures, the blade airfoils that generally have fast thermal response rates and the rotor disk, that generally responds slower.

As a result, both configurations require large tip clearances throughout the operating range. Large tip clearance can equate to lower efficiency. By minimizing the tip clearance between the rotating and static structures efficiency can be improved. In some designs, an annular control ring is provided on the outer static structure to control the thermal response of the blade outer air seal system, at least under some operational conditions.

Such conventional methods and systems have generally been considered satisfactory for their intended purpose. However, there is still a need in the art for an improved sealing system. The present disclosure provides a solution for this need.

SUMMARY

A rotating blade tip clearance system includes a control ring carrier, e.g. a carrier, for retaining a control ring therein and defining a centerline axis. The carrier has a connecting portion for connecting to a case, a retaining portion radially inward of the connecting portion, and a flange connecting radially between the connecting portion and the retaining portion. The flange isolates the retaining portion of the control ring carrier from the thermal deflection of a case and assists in keeping the control ring carrier aligned about centerline axis A during thermal deflection. The retaining portion includes radially inner and outer diameter sides defining a retaining cavity therebetween for retaining a control ring therein. The system includes a control ring within the retaining cavity of the control ring carrier. The control ring has a different thermal response rate from the carrier so that the control ring thermally deflects slower than the control ring carrier, thereby controlling the rate and/or extent of thermal deflection of the control ring carrier.

The system can include a cover engaged with the inner and outer diameter sides of the retaining portion of the control ring carrier and the control ring to cover the retaining cavity of the control ring carrier. The cover can include protrusions extending axially outward from an aft facing surface of the cover for engaging with recessed pockets of the control ring. The cover can include circumferentially spaced hooks on an inner diameter side of the cover for engaging with the inner diameter side of the retaining portion of the control ring carrier and a lip on an outer diameter side of the cover for engaging with the outer diameter side of the retaining portion of the control ring carrier.

The system can include an outer air seal engaged with the control ring carrier. The control ring carrier can thermally isolate the control ring from the outer air seal. The inner diameter side of the retaining portion of the control ring carrier can include hooks that extend radially inward to engage with an outer air seal. The connecting portion of the control ring carrier can include an annular hook that extends radially outward to engage with a case. The retaining portion of the control ring carrier can include recessed pockets defined in cavity facing surfaces of each of the inner and outer diameter sides of the retaining portion to thermally isolate the control ring from the control ring carrier.

The system can include connector segments between the control ring and the control ring carrier. The control ring, the control ring carrier and the connector segments can be manufactured as a single unit by casting, direct metal laser sintering (DMLS), or by any other suitable process, e.g., wherein the control ring, the control ring carrier and the connector segments are different materials. The control ring can include multiple arcuate segments joined together to form the control ring carrier. Joints between the multiple arcuate segments of the control ring can each be secured with a radially oriented pin. The control ring carrier can include multiple arcuate segments that join together to form the control ring carrier. Joints between the multiple arcuate segments of the control ring carrier can each be secured with a radially oriented pin.

In accordance with certain embodiments, a blade tip clearance system includes a carrier defining a centerline axis having inner and outer diameter sides with a retaining cavity therebetween, a control ring, and a splined carrier. The control ring is within the retaining cavity of the control ring carrier and is similar to the control ring described above. The splined carrier surrounds at least a portion of the control ring carrier and includes circumferentially spaced apart splines for engaging corresponding axial protrusions extending in a forward direction from the control ring carrier. The control ring has a different thermal response rate from the splined carrier and the control ring carrier so that the control ring thermally expands slower than the splined carrier and the control ring carrier. The outer diameter side of the splined carrier can include an annular hook that extends radially outward to engage with a case.

These and other features of the systems and methods of the subject disclosure will become more readily apparent to those skilled in the art from the following detailed description of the preferred embodiments taken in conjunction with the drawings.

BRIEF DESCRIPTION OF THE DRAWINGS

So that those skilled in the art to which the subject disclosure appertains will readily understand how to make and use the devices and methods of the subject disclosure without undue experimentation, preferred embodiments thereof will be described in detail herein below with reference to certain figures, wherein.

DETAILED DESCRIPTION OF THE DISCLOSURE

Figure 1:
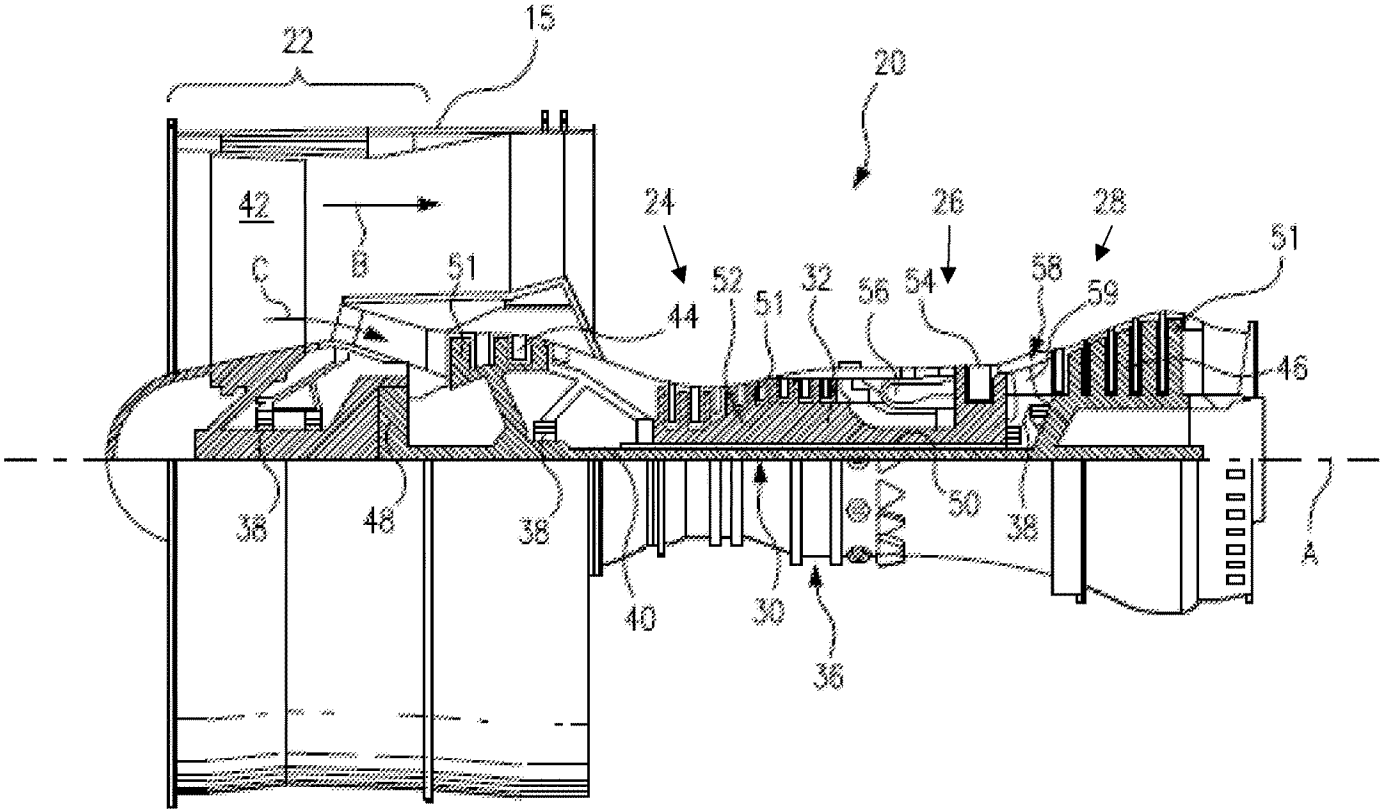
FIG. 1 is a schematic cross-sectional side elevation view of an exemplary embodiment of a gas turbine engine constructed in accordance with the present disclosure, showing the location of the blades.

Reference will now be made to the drawings wherein like reference numerals identify similar structural features or aspects of the subject disclosure. For purposes of explanation and illustration, and not limitation, a partial view of an exemplary embodiment of the blade tip clearance system is depicted in FIG. 2 and is designated generally by reference character 100. Other embodiments of blade tip clearance systems in accordance with various embodiments, or aspects thereof, are provided in FIGS. 1 and 3-12*b*, as will be described. The systems and methods described herein can be used to provide improved tip clearance control between the rotating blade tip and static blade outer air seal at various operating conditions experienced in gas turbine engines.

Figure 2:
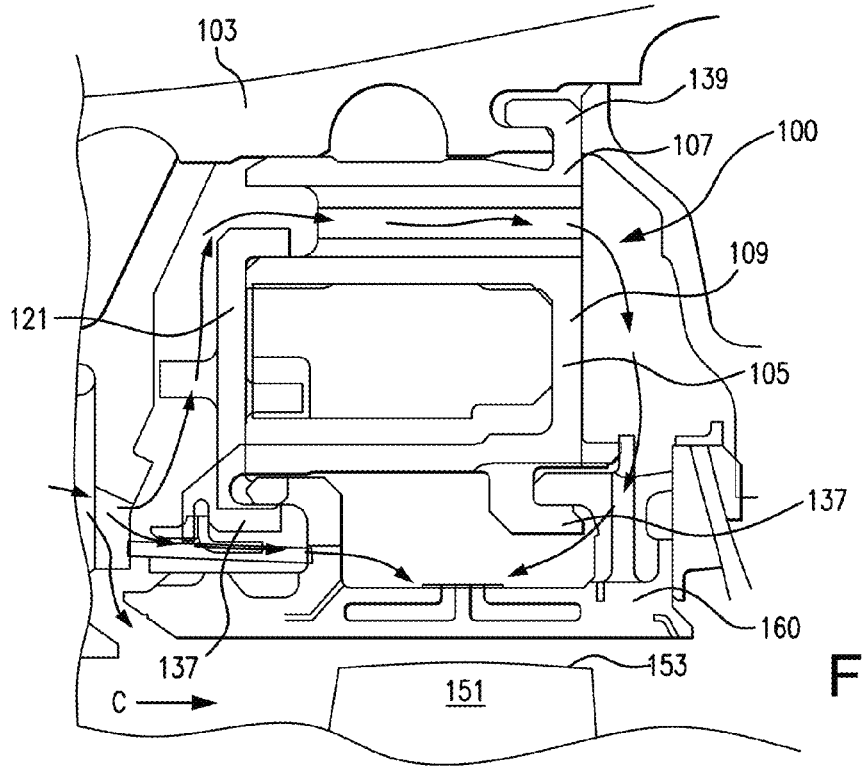
FIG. 2 is a schematic cross-sectional side elevation view of a blade tip clearance system constructed in accordance with embodiments of the present disclosure, showing the interface of the blade tip clearance system and the blade tip in a cold state.

FIG. 1 schematically illustrates a gas turbine engine 20. The gas turbine engine 20 is disclosed herein as a two-spool turbofan that generally incorporates a fan section 22, a compressor section 24, a combustor section 26 and a turbine section 28. Alternative engines might include an augmentor section (not shown) among other systems or features. The fan section 22 drives air along a bypass flow path B in a bypass duct defined within a nacelle 15, while the compressor section 24 drives air along a core flow path C for compression and communication into the combustor section 26 then expansion through the turbine section 28. Although depicted as a two-spool turbofan gas turbine engine in the disclosed non-limiting embodiment, it should be understood that the concepts described herein are not limited to use with two-spool turbofans as the teachings may be applied to other types of turbine engines including three-spool architectures.

The exemplary engine 20 generally includes a low speed spool 30 and a high speed spool 32 mounted for rotation about an engine central longitudinal axis A relative to an engine static structure 36 via several bearing systems 38. It should be understood that various bearing systems 38 at various locations may alternatively or additionally be provided, and the location of bearing systems 38 may be varied as appropriate to the application.

The low speed spool 30 generally includes an inner shaft 40 that interconnects a fan 42, a low pressure compressor 44 and a low pressure turbine 46. The inner shaft 40 is connected to the fan 42 through a speed change mechanism, which in exemplary gas turbine engine 20 is illustrated as a geared architecture 48 to drive the fan 42 at a lower speed than the low speed spool 30. The high speed spool 32 includes an outer shaft 50 that interconnects a high pressure compressor 52 and high pressure turbine 54. A combustor 56 is arranged in exemplary gas turbine 20 between the high pressure compressor 52 and the high pressure turbine 54. A mid-turbine frame 58 of the engine static structure 36 is arranged generally between the high pressure turbine 54 and the low pressure turbine 46. The mid-turbine frame 58 further supports bearing systems 38 in the turbine section 28. The inner shaft 40 and the outer shaft 50 are concentric and rotate via bearing systems 38 about the engine central longitudinal axis A which is collinear with their longitudinal axes.

The core airflow is compressed by the low pressure compressor 44 then the high pressure compressor 52, mixed and burned with fuel in the combustor 56, then expanded over the high pressure turbine 54 and low pressure turbine 46. The mid-turbine frame 58 includes airfoils 59 that are in the core airflow path C. The turbines 46, 54 rotationally drive the respective low speed spool 30 and high speed spool 32 in response to the expansion. It will be appreciated that each of the positions of the fan section 22, compressor section 24, combustor section 26, turbine section 28, and fan drive gear system 48 may be varied. For example, gear system 48 may be located aft of combustor section 26 or even aft of turbine section 28, and fan section 22 may be positioned forward or aft of the location of gear system 48.

The engine 20 in one example is a high-bypass geared aircraft engine. In a further example, the engine 20 bypass ratio is greater than about six (6), with an example embodiment being greater than about ten (10), the geared architecture 48 is an epicyclic gear train, such as a planetary gear system or other gear system, with a gear reduction ratio of greater than about 2.3 and the low pressure turbine 46 has a pressure ratio that is greater than about five (5:1). In one disclosed embodiment, the engine 20 bypass ratio is greater than about ten (10:1), the fan diameter is significantly larger than that of the low pressure compressor 44, and the low pressure turbine 46 has a pressure ratio that is greater than about five (5:1). Low pressure turbine 46 pressure ratio is pressure measured prior to inlet of low pressure turbine 46 as related to the pressure at the outlet of the low pressure turbine 46 prior to an exhaust nozzle. The geared architecture 48 may be an epicycle gear train, such as a planetary gear system or other gear system, with a gear reduction ratio of greater than about 2.3:1. It should be understood, however, that the above parameters are only exemplary of one embodiment of a geared architecture engine and that the present disclosure is applicable to other gas turbine engines including direct drive turbofans.

A significant amount of thrust is provided by the bypass flow B due to the high bypass ratio. The fan section 22 of the engine 20 is designed for a particular flight condition—typically cruise at about 0.8 Mach and about 35,000 feet. The flight condition of 0.8 Mach and 35,000 ft, with the engine at its best fuel consumption—also known as "bucket cruise Thrust Specific Fuel Consumption ('TSFC')"—is the industry standard parameter of lbm of fuel being burned divided by lbf of thrust the engine produces at that minimum point. "Low fan pressure ratio" is the pressure ratio across the fan blade alone, without a Fan Exit Guide Vane ("FEGV") system. The low fan pressure ratio as disclosed herein according to one non-limiting embodiment is less than about 1.45. "Low corrected fan tip speed" is the actual fan tip speed in ft/sec divided by an industry standard temperature correction of $[(\text{Tram}\ ^\circ\ \text{R})/(518.7^\circ\ \text{R})]^{0.5}$. The "Low corrected fan tip speed" as disclosed herein according to one non-limiting embodiment is less than about 1150 ft/second.

As shown in FIGS. 1 and 2, gas turbine engine 20 includes rotating structures, e.g. high and low speed spools 32 and 30, with a plurality of rotating blades 51 and 151. With reference now to FIG. 2, each of the plurality of rotating blades 151 includes a radially outward tip 153. A blade tip clearance system 100 is located outboard of the radially outward tip 153. An external case 103 surrounds blade tip clearance system 100. Blade tip clearance system 100 includes a control ring carrier 105, e.g. a carrier, defining a centerline axis, e.g. engine central longitudinal axis A. Carrier 105 includes a connecting portion 107, e.g. a connecting portion, and a retaining portion 109, e.g. a retaining portion, radially inward of connecting portion 107.

Figure 3:
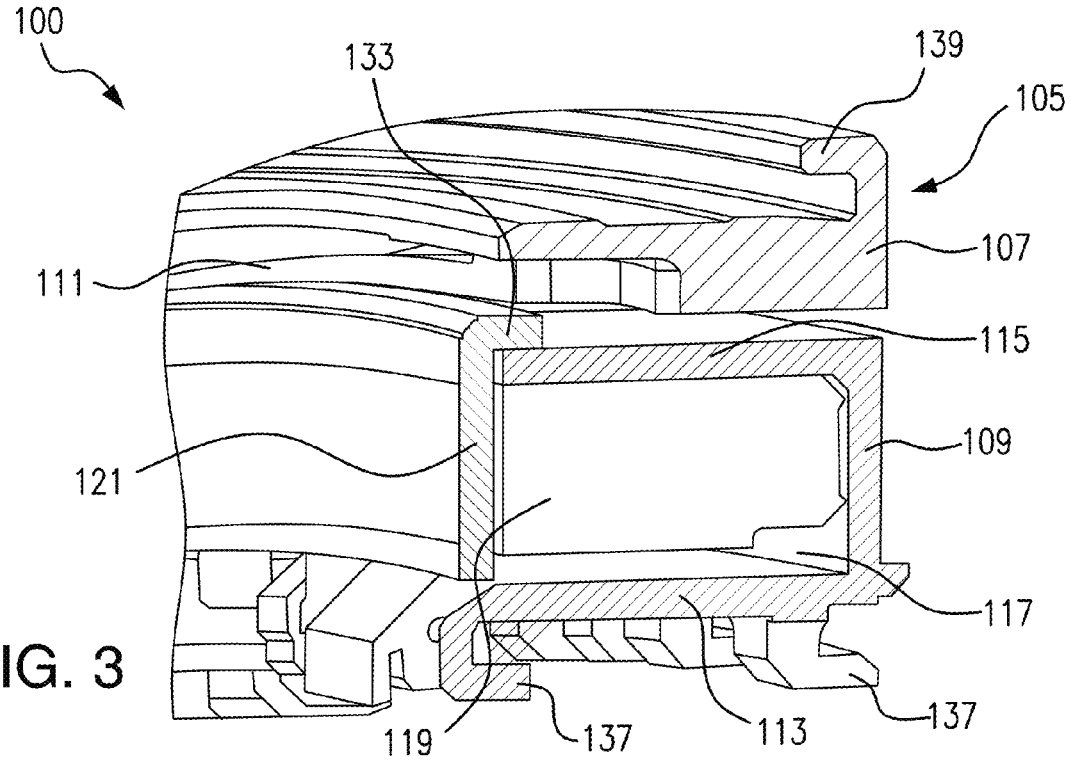
FIG. 3 is a perspective cut-away view of a portion of the blade tip clearance system of FIG. 2, showing the control ring, the control ring carrier and the cover.

With reference now to FIGS. 2 and 3, carrier 105 includes a flange 111, e.g. a spring component, connecting between connecting portion 107 and retaining portion 109. Retaining portion 109 includes inner and outer diameter sides, 113 and 115, respectively, defining a retaining cavity 117 therebetween. System 100 includes a control ring 119 within retaining cavity 117 of carrier 105. Control ring 119 has a different thermal response rate from carrier 105 so that control ring 119 thermally expands and contracts slower than carrier 105. It is contemplated that carrier 105 and control ring 119 can be assembled in an interference fit at either inner or outer diameter sides, 113 and 115, respectively. The interference fit provides a combined thermal response of the relatively slow responding control ring 119 and the relatively fast responding carrier 105. Control ring 119 prevents carrier 105 from closing down the blade tip gap during engine start-up and deceleration, e.g. transient periods. It is contemplated that the initial interference fit on the cold build engine can be the result of extrapolating backwards from a mission time point where it is desired that the control ring, e.g. control ring 119, hold the control ring carrier, e.g. carrier 105, radially outward, for example, upon deceleration, as is described in further detail below.

Those having skill in the art will readily appreciate that materials for carrier 105, cover 121 (described below), and control ring 119 can be selected with specific coefficients of thermal expansion (CTE) in order to optimize the timing and sequence for when control ring 119 imparts loads to carrier 105. In some embodiments, the CTE of carrier 105 can be equal to that of the CTE of control ring 119, however the thermal response rate of carrier 105 can still be higher than that of the control ring 119, as thermal response rate is a result of other factors, such as, mass, insulation, and the like.

Those skilled in the art will readily appreciate that by using two separate components, e.g., carrier 105 and control ring 119, to control the radial position of an outer air seal, described below, material properties can be controlled as needed for a given application. For example, carrier 105 can be configured to respond quickly during rapid acceleration and deceleration throttle excursions, while control ring 119 can be configured to respond slower than carrier 105 in order to mirror the thermal response rate of larger rotating structures, e.g. a rotor disk of the high and low speed spools 32 and 30.

With continued reference to FIGS. 2 and 3, system 100 can include an outer air seal 160, e.g., a blade outer air seal (BOAS), engaged with carrier 105. The blade outer air seal 160 seals or restricts air flowing along core flow path C passing outboard of the blade tips 153. Thermal expansion and contraction of blade tip clearance system 100 causes controlled clearances between BOAS 160 and the radially outward tips 153 of the rotating blades 151, and occurs independently of thermal response and radial positioning of the external case 103. Carrier 105 thermally isolates control ring 119 from BOAS 160. Inner diameter side 113 of retaining portion 109 of carrier 105 includes hooks 137 that extend radially inward to engage with BOAS 160. It is contemplated that instead of hooks 137, BOAS 160 can be connected to carrier 105 by using full hoop hooks, dove tails, bolts, rivets, or the like.

With continued reference to FIG. 2, system 100 includes a cover 121 engaged with the inner and outer diameter sides 113 and 115, respectively, of retaining portion 109 of carrier 105 and control ring 119 to cover retaining cavity 117 of carrier 105. Cover 121 helps to thermally isolate control ring 119. Connecting portion 107 of carrier 105 can include an annular hook 139 that extends radially outward to engage with case 103. Instead of annular hook 139, e.g. a full-hoop hook, carrier 105 can be connected to case 103 by segmented hooks, e.g. hooks 137, dove tails, bolts, rivets, or the like. It is contemplated that control ring 119, carrier 105 and cover 121 can be arcuate segments joined together to form a full control ring 119, a full carrier ring 105 and a full cover ring 121, respectively. It is also contemplated that control ring 119, carrier 105 and cover 121 can be integrally formed as respective full rings.

Figure 4:
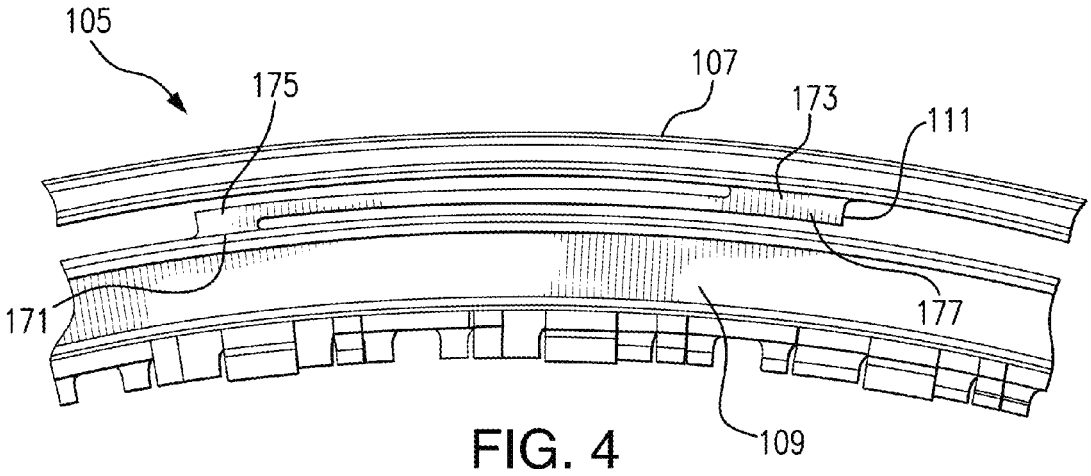
FIG. 4 is an axial view of a portion of the control ring carrier of FIG. 2, showing the connecting portion, the retaining portion, and the spring component.

With reference now to FIG. 4, spring component 111 connects connecting portion 107 of carrier 105 to retaining portion 109 of carrier 105. While only one spring component 111 is shown, those having skill in the art will readily appreciate that multiple spring components 111 can be circumferentially spaced about carrier 105. Further, it is contemplated that spring components 111 can be made separately from and joined to connecting portion 107 and retaining portion 109, or spring components 111 can be integral with connecting portion 107 and retaining portion 109, as shown.

With continued reference to FIG. 4, spring component 111 isolates retaining portion 109 of carrier 105 and control ring 119 from the thermal deflection of case 103 and assists in keeping carrier 105, control ring 119 and cover 121 aligned about centerline axis A during thermal deflection. Spring component 111 is a circumferentially extending arcuate segment that includes an inner diameter side 171 and an outer diameter side 173. Inner diameter side 171 is connected to retaining portion 109 at a first end 175 of spring component 111 and outer diameter side 173 is connected to connecting portion 107 at a second end 177, such that the connection between spring component 111 and retaining portion 109 is circumferentially spaced apart from the connection between spring component 111 and connecting portion 107.

Figure 5:
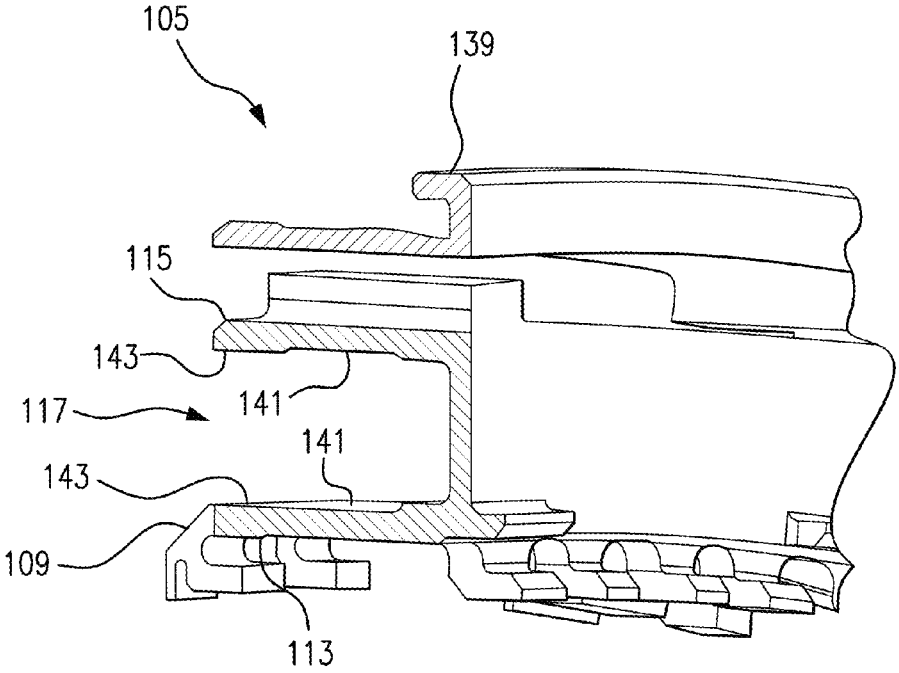
FIG. 5 is a perspective cut-away view of a portion of the control ring carrier of FIG. 2, showing the recessed pockets of the retaining cavity.

As shown in FIG. 5, retaining portion 109 of carrier 105 includes recessed pockets 141 defined in cavity facing surfaces 143 of inner and outer diameter sides 113 and 115, respectively, of retaining portion 109. Recessed pockets 141 minimize contact between carrier 105 and control ring 119 to thermally isolate control ring 119 from carrier 105.

Figure 6:
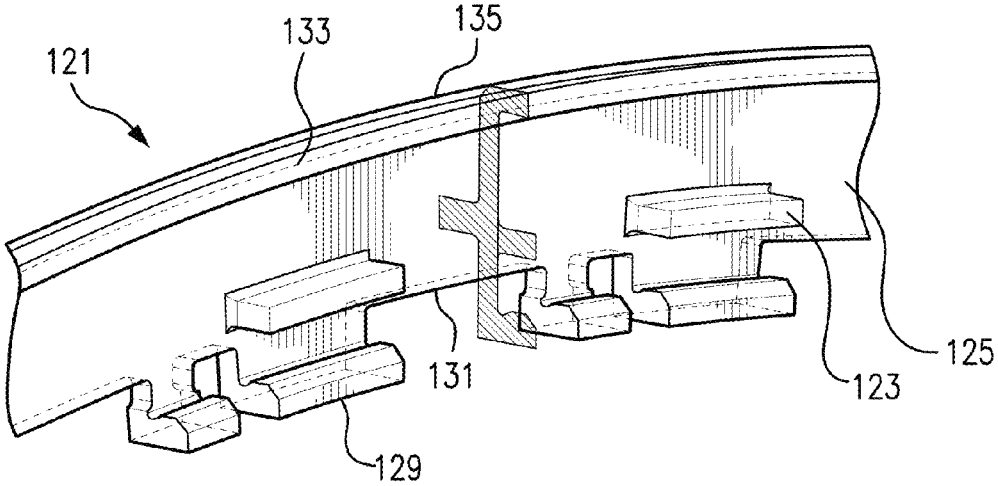
FIG. 6 is a perspective view of a portion of the cover of FIG. 2, showing an aft facing surface of the cover having axially extending protrusions.
Figure 7:
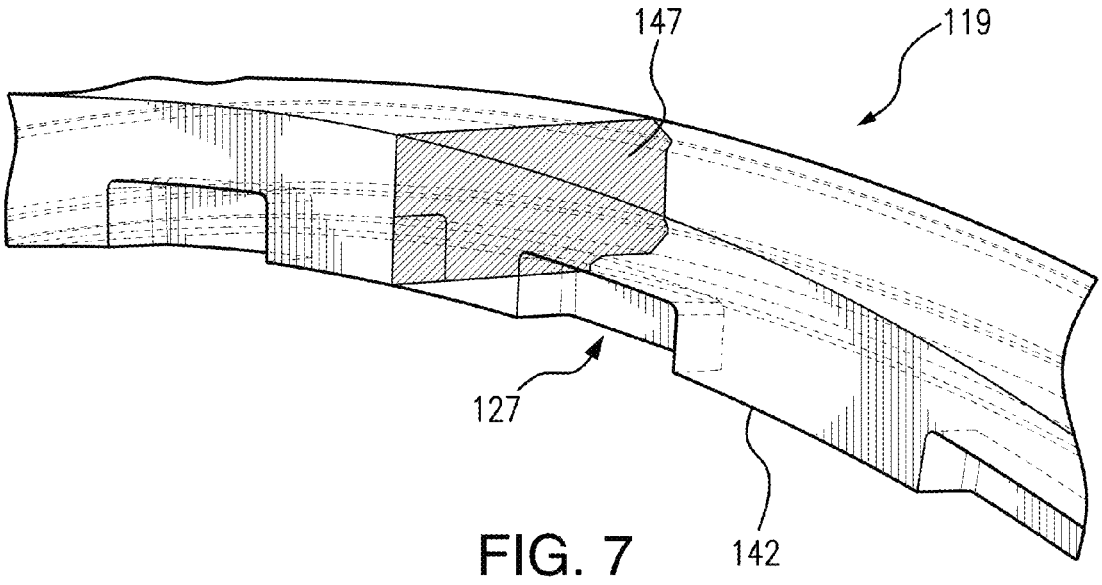
FIG. 7 is a perspective view of a portion of the control ring of FIG. 2, showing a forward facing surface of the control having recessed pockets that correspond to the axially extending protrusions of the cover.

With reference now to FIGS. 6 and 7, cover 121 includes protrusions 123 extending axially outward from an aft facing surface 125 of the cover for engaging with recessed pockets 127 of control ring 119. Protrusions 123 help to keep the control ring 119 centered during operation. Cover 121 includes circumferentially spaced hooks 129 on an inner diameter side 131 of cover 121 for engaging with inner diameter side 113 of the retaining portion of carrier 105, as shown in FIG. 3. Cover 121 also includes a lip 133 on an outer diameter side 135 of cover 121 for engaging with outer diameter side 115 of retaining portion 109 of carrier 105. It is also contemplated that control ring 119 can include recessed pockets (not shown) on its inner and outer diameter surfaces, 142 and 147, respectively.

During the start of operation of an engine, e.g. gas turbine engine 20, secondary air flow, schematically shown in FIG. 2, begins to flow to BOAS 160 and around system 100. Cover 121 and carrier 105 heat up and expand radially outward before control ring 119 due to their higher thermal response rate. Similarly, blade tips 153 move radially outward as blades 151 grow. The expansion of cover 121 and carrier 105 move BOAS 160 outward to avoid clashing with blade tips 153. The rotor (not shown) expands slower than blades 151, but eventually heats up enough to expand and move blade 151 radially outward. Control ring 119 heats up and expands at a similar rate as the rotor, pushing carrier 105 further out and moving BOAS 160 outward to again avoid clashing with the blade tips 153.

Upon deceleration, the rotor stays warm, keeping blades 151 in a radially outward position. In traditional systems, the remaining components, such as a control ring, would cool down prior to the rotor, thereby contracting radially inward and requiring increased blade clearance to account for this variation. In system 100, however, control ring 119 is isolated and stays hot along with the rotor, preventing carrier 105 from contracting, and therefore reducing the required tip clearance.

Figure 8:
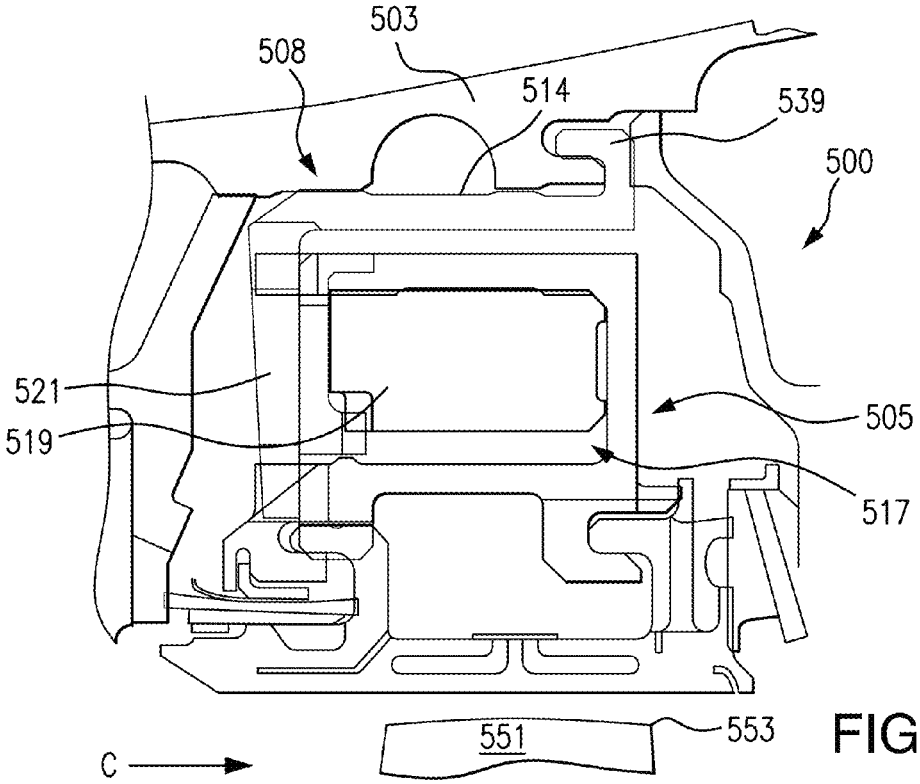
FIG. 8 is a cross-sectional side elevation view of another embodiment of a blade tip clearance system constructed in accordance with embodiments of the present disclosure, showing the interface of the blade tip clearance system and the blade tip in a cold state.

As shown in FIG. 8, another embodiment of a blade tip clearance system 500 includes a carrier 505 defining a centerline axis, e.g. engine central longitudinal axis A. System 500 is similar to system 100, described above, but carrier 505 does not include a connecting portion, e.g. connecting portion 107 and a spring component, e.g. spring component 111. Instead, carrier 505 only includes a retaining portion 509. Retaining portion 509 is similar to retaining portion 109, described above. Carrier 505 also includes axial protrusions 512, described in more detail below. System 500, in contrast to system 100, also includes a splined carrier 508 instead of a spring component 111.

Figure 9:
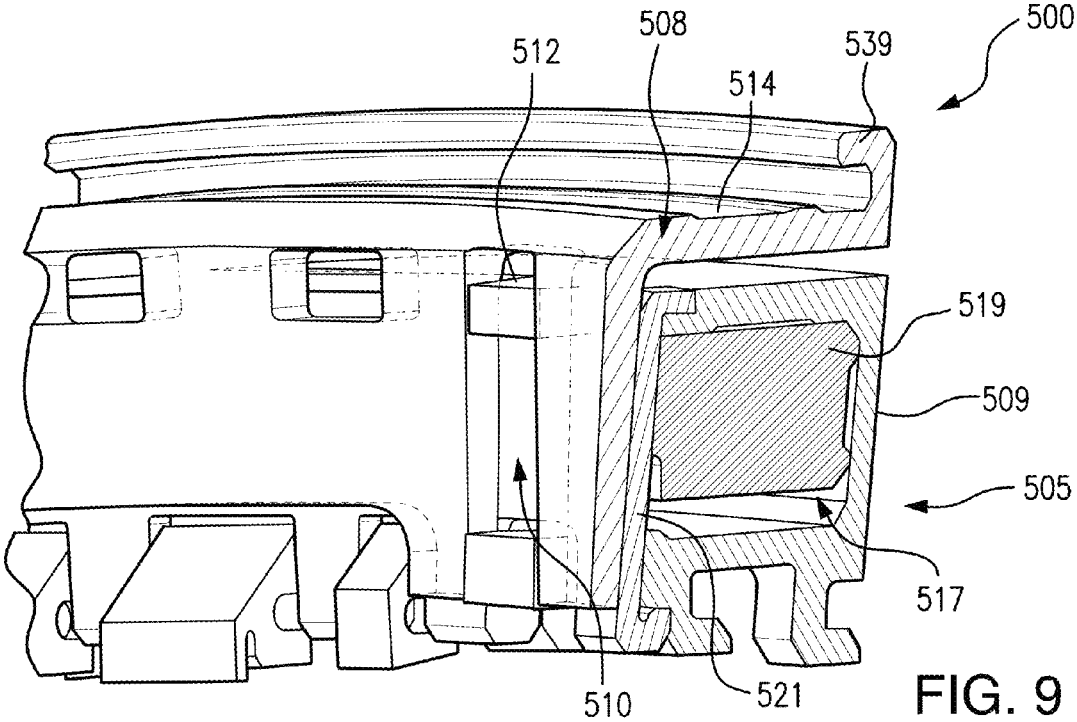
FIG. 9 is a perspective cut-away view of a portion of the blade tip clearance system of FIG. 8, showing the control ring, the control ring carrier, the splined carrier and the cover.

With reference now to FIG. 9, splined carrier 508 surrounds at least a portion of carrier 505 and includes circumferentially spaced apart radially extending splines 510 for engaging corresponding axial protrusions 512 extending in a forward direction from carrier 505. Splined carrier 508 also acts to further isolate carrier 505 and control ring 519 from case 503. Splines 510 permit carrier 505 and control ring 519 to move radially as needed with respect to splined carrier 508, making the thermal deflections of control ring 519 and carrier 505 largely independent of case 503, while still keeping carrier 505 and control ring 519 aligned about centerline axis A. Control ring 519 is within a retaining cavity 517 of carrier 105 and is similar to control ring 119 described above. Control ring 519 has a different thermal response rate from splined carrier 508 and carrier 505 so that control ring 519 thermally expands slower than splined carrier 508 and carrier 105. An outer diameter side 514 of splined carrier 508 includes an annular hook 539 that extends radially outward to engage with a case 503.

Figure 10:
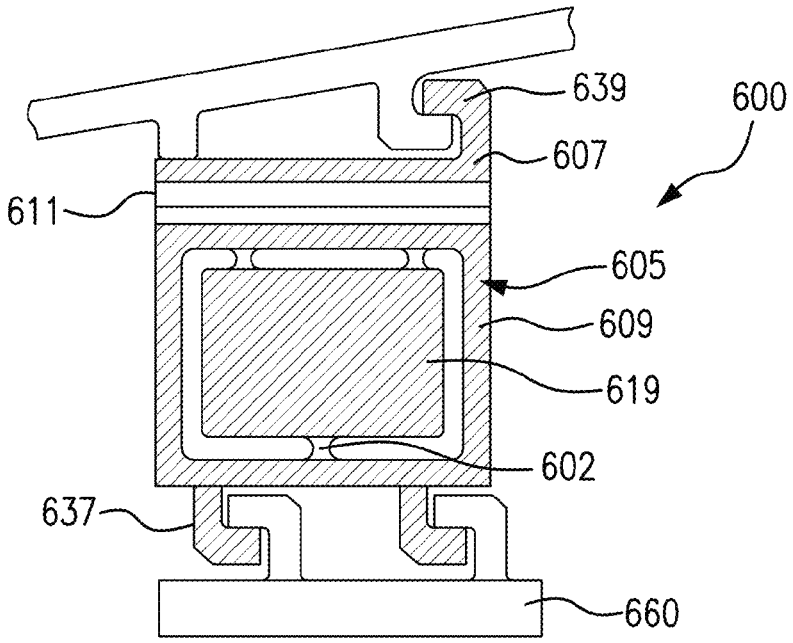
FIG. 10 is a cross-sectional side elevation view of another embodiment of a blade tip clearance system constructed in accordance with embodiments of the present disclosure, showing an integrally formed carrier and control ring.

Now with reference to FIG. 10, another embodiment of a blade tip clearance system 600 is shown. System 600 is similar to system 100, but a cover, e.g. cover 121, is integrally formed as part of a carrier 605, and carrier 605 and a control ring 619 are formed as a single integral unit. Carrier 605 and control ring 619 are connected with connector segments 602 between control ring 619 and carrier 605. It is contemplated that connector segments 602 can be a ceramic material. Carrier 605 is substantially the same as carrier 105, in that it includes a connecting portion 607 and a retaining portion 609 radially inward of connecting portion 607. Connecting portion 607 also includes an annular hook 639, similar to annular hook 139, hooks 637, similar to hooks 137, and a spring component 611, similar to spring component 111. While shown with a spring component 611, those skilled in the art will readily appreciate that this could be replaced by a splined carrier, e.g. splined carrier 508, as described above.

With continued reference to FIG. 10, control ring 619, carrier 605 and connector segments 602 can be manufactured as a single unit by either casting or DMLS. This permits control ring 619, carrier 605 and connector segments 602 to be made from different materials, for example, depending on the desired thermal response rate of each component. The single unit can be an annular segment joined together to form a single ring, as will be described below, or it can be a single ring. It is contemplated that casting carrier 605 and control ring 619 as an integral arcuate segment or entire ring can include casting or machining control ring 619, adding ceramic inserts as part of a wax pattern to create connector segments 602, and casting carrier 605 around control ring 619 and connector segments.

Figure 11:
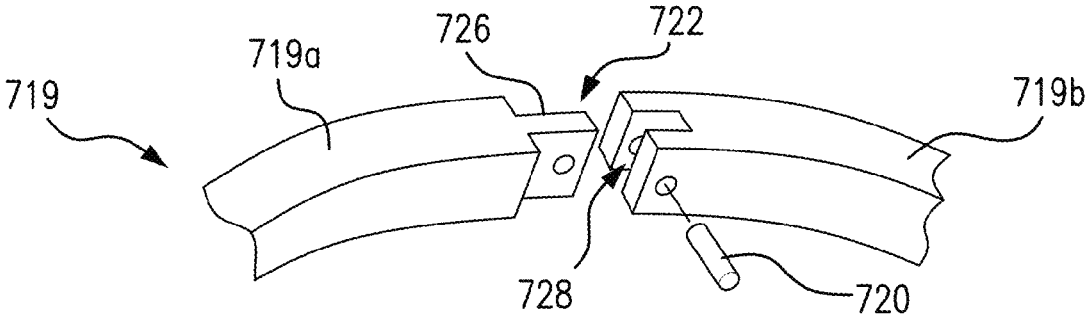
FIG. 11 is an exploded perspective view of a portion of another embodiment of a control ring constructed in accordance with embodiments of the present disclosure, showing the control ring having segmented portions.

As shown in FIG. 11, a segmented control ring 719 is shown. Those skilled in the art will readily appreciate that control rings 119, 519 and 619 can be continuous rings or segmented as shown in FIG. 11. Segmented control ring 719 includes multiple arcuate segments, 719*a* and 719*b*, for example, that are joined together to act as a full hoop during engine operation. The segments 719*a* and 719*b* are joined together at a flanged joint 722 and secured using a radially oriented pin 720 to form a full hoop. Flanged joint 722 includes a flange 726 on one segment 719*a* and a corresponding slot 728 on the other segment 719*b*. Those skilled in the art will readily appreciate that while pin 720 is shown securing flanged joint 722, a variety of suitable securing components can be used, for example, a rivet, a bolt, or the like.

Figure 12A:
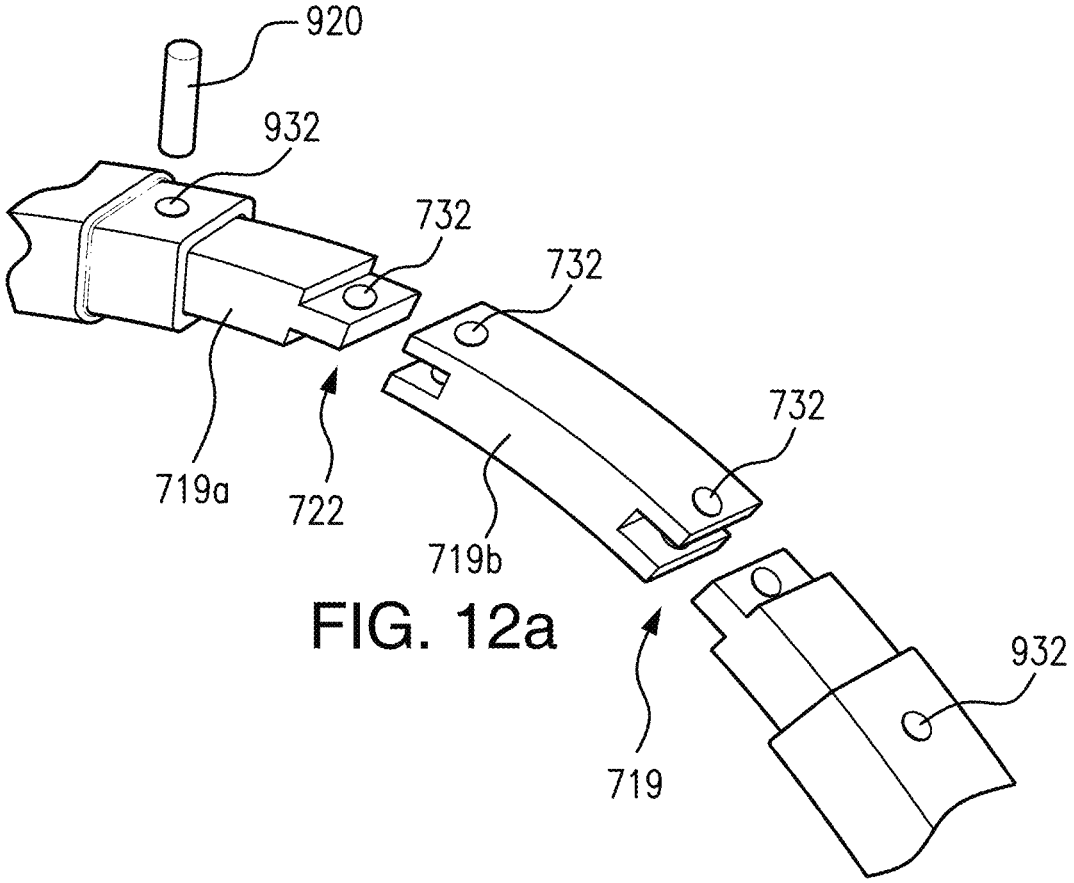
FIG. 12*a* is an exploded perspective view of a portion of another embodiment of a carrier constructed in accordance with embodiments of the present disclosure, showing the control ring carrier having segmented portions.
Figure 12B:
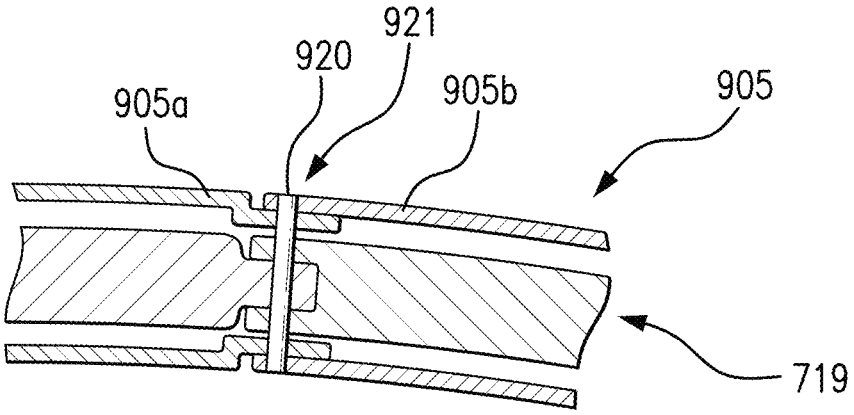
FIG. 12*b* is a cross-sectional axial view of a portion of the control ring carrier of FIG. 12*a*, showing the segmented portions of the control ring carrier and control ring being joined together.

Now with reference to FIGS. 12*a* and 12*b*, control ring 719 is shown being assembled into a carrier 905. Carrier 905 is shown schematically and can be similar to carriers 105, 505 and 605. Carrier 905 is shown as a segmented carrier. Those skilled in the art will readily appreciate that carriers 105, 505 and 605 can be continuous rings or segmented as shown in FIGS. 12*a* and 12*b*. Segmented carrier 905 includes multiple arcuate segments, for example, a male portion 905*a* and a female portion 905*b*, where when joined together, male portion 905*a* nests within female portion 905*b*. Each of male and female portions 905*a* and 905*b*, respectively, include pin holes 932 that align when male and female portions 905*a* and 905*b*, respectively, are nested together. Pin holes 932 are secured together to form a joint 921 using a radially oriented pin 920. Pin 920 is similar to pin 720, described above, and also acts to keep control ring 719 axially and circumferentially aligned within carrier 905, while still allowing thermal deflection. Segmented carrier 905 includes multiple arcuate segments, for example, male and female portions 905*a* and 905*b* described above, that are joined together to act as a full hoop during engine operation.

The methods and systems as described above and shown in the drawings, can provide for a blade tip clearance system with superior properties including reduced blade tip clearance over a flight envelope. While the apparatus and methods of the subject disclosure have been shown and described with reference to preferred embodiments, those skilled in the art will readily appreciate that changes and/or modifications may be made thereto without departing from the scope of the subject disclosure.

What is claimed is:

1. A rotating blade tip clearance system for a gas turbine engine, comprising:

a control ring carrier for retaining a control ring therein, the control ring carrier defining a centerline axis and having:

a connecting portion for connecting to a case;

a retaining portion radially inward of the connecting portion, wherein the retaining portion includes radially inner and outer diameter sides defining a retaining cavity therebetween for retaining a control ring therein; and a flange connecting radially between the connecting portion and the retaining portion, wherein the flange isolates the retaining portion of the control ring carrier from a thermal deflection of a case and assists in keeping the control ring carrier aligned about centerline axis A during thermal deflection;

a control ring within the retaining cavity of the control ring carrier, wherein the control ring has a different thermal response rate from the control ring carrier so that the control ring thermally deflects slower than the control ring carrier, thereby controlling a rate and/or an extent of thermal deflection of the control ring carrier; and a cover engaged with the inner and outer diameter sides of the retaining portion of the control ring carrier and the control ring to cover the retaining cavity of the control ring carrier, wherein the cover includes protrusions extending axially outward from an aft facing surface of the cover for engaging with recessed pockets of the control ring.

2. A rotating blade tip clearance system as recited in claim 1, wherein the cover includes circumferentially spaced hooks on an inner diameter side of the cover for engaging with the inner diameter side of the retaining portion of the control ring carrier and a lip on an outer diameter side of the cover for engaging with the outer diameter side of the retaining portion of the control ring carrier.

3. A rotating blade tip clearance system as recited in claim 1, further comprising an outer air seal engaged with the control ring carrier, wherein the control ring carrier thermally isolates the control ring from the outer air seal.

4. A rotating blade tip clearance system as recited in claim 1, wherein the inner diameter side of the retaining portion of the control ring carrier includes hooks that extend radially inward to engage with an outer air seal.

5. A rotating blade tip clearance system as recited in claim 1, wherein the connecting portion of the control ring carrier includes an annular hook that extends radially outward to engage with a case.

6. A rotating blade tip clearance system as recited in claim 1, wherein the retaining portion of the control ring carrier includes recessed pockets defined in cavity facing surfaces of each of the inner and outer diameter sides of the retaining portion to thermally isolate the control ring from the control ring carrier.

7. A rotating blade tip clearance system as recited in claim 1, further comprising connector segments between the control ring and the control ring carrier, wherein the control ring, the control ring carrier and the connector segments are each manufactured as a single unit by one of casting or direct metal laser sintering.

8. A rotating blade tip clearance system as recited in claim 1, wherein the control ring includes multiple arcuate segments joined together to form the control ring, wherein joints between the multiple arcuate segments are each secured with a radially oriented pin.

9. A rotating blade tip clearance system as recited in claim 1, wherein the control ring carrier includes multiple arcuate segments that join together to form the control ring carrier, joints between the multiple arcuate segments are each secured with a radially oriented pin.

10. A rotating blade tip clearance system for a gas turbine engine, comprising:

a control ring carrier for retaining a control ring therein, the control ring carrier defining a centerline axis and having:

a connecting portion for connecting to a case;

a retaining portion radially inward of the connecting portion, wherein the retaining portion includes radially inner and outer diameter sides defining a retaining cavity therebetween for retaining a control ring therein; and a flange connecting radially between the connecting portion and the retaining portion, wherein the flange isolates the retaining portion of the control ring carrier from a thermal deflection of a case and assists in keeping the control ring carrier aligned about centerline axis A during thermal deflection;

a control ring within the retaining cavity of the control ring carrier, wherein the control ring has a different thermal response rate from the control ring carrier so that the control ring thermally deflects slower than the control ring carrier, thereby controlling a rate and/or an extent of thermal deflection of the control ring carrier; and connector segments between the control ring and the control ring carrier, wherein the control ring, the control ring carrier and the connector segments are each manufactured as a single unit by one of casting or direct metal laser sintering; wherein the control ring, the control ring carrier and the connector segments are different materials.

11. A rotating blade tip clearance system comprising:

a control ring carrier for retaining a control ring therein, the control ring carrier defining a centerline axis having radially inner and outer diameter sides with a retaining cavity therebetween for retaining a control ring therein;

a control ring within the retaining cavity of the control ring carrier;

a splined carrier surrounding at least a portion of the control ring carrier, wherein the splined carrier includes circumferentially spaced apart splines for engaging corresponding axial protrusions extending in a forward direction from the control ring carrier, and wherein the control ring has a different thermal response rate from the splined carrier and the control ring carrier so that the control ring thermally deflects slower than the splined carrier and the control ring carrier, thereby controlling a rate and/or an extent of thermal deflection of the control ring carrier and the splined carrier; and a cover engaged with the inner and outer diameter sides of the control ring carrier and the control ring to cover the retaining cavity of the control ring carrier, wherein the cover includes protrusions extending axially outward from an aft facing surface of the cover for engaging with recessed pockets of the control ring.

12. A rotating blade tip clearance system as recited in claim 11, wherein the cover includes circumferentially spaced hooks on an inner diameter side of the cover for engaging with the inner diameter side of the control ring carrier and a lip on an outer diameter side of the cover for engaging with the outer diameter side of the control ring carrier.

13. A rotating blade tip clearance system as recited in claim 11, further comprising an outer air seal engaged with the control ring carrier, wherein the control ring carrier thermally isolates the control ring from the outer air seal.

14. A rotating blade tip clearance system as recited in claim 11, wherein the inner diameter side of the control ring carrier includes hooks that extend radially inward to engage with an outer air seal.

15. A rotating blade tip clearance system as recited in claim 11, wherein an outer diameter side of the splined carrier includes an annular hook that extends radially outward to engage with a case.

16. A rotating blade tip clearance system as recited in claim 11, wherein the control ring carrier includes recessed pockets defined in cavity facing surfaces of each of the inner and outer diameter sides to thermally isolate the control ring from the control ring carrier.

* * * * *